United States Patent [19]

Brunea et al.

[11] Patent Number: 4,936,607

[45] Date of Patent: Jun. 26, 1990

[54] SECURITY FOR IMAGES FORMED BY IMPACT BASED SYSTEMS

[75] Inventors: Robert W. Brunea, Portland, Oreg.; James M. Raby, Youngstown, N.Y.

[73] Assignee: Moore Business Forms, Inc., Glenview, Ill.

[21] Appl. No.: 149,080

[22] Filed: Jan. 27, 1988

[51] Int. Cl.[5] ..... B42D 15/00

[52] U.S. Cl. ..... 283/70; 156/277; 162/140; 283/58; 283/95; 428/321.5; 428/914; 428/916; 503/207; 503/215

[58] Field of Search ..... 283/58, 95, 8 L, 70; 156/277; 162/140; 428/321.5, 914, 916; 503/207, 215

[56] References Cited

U.S. PATENT DOCUMENTS

| | | | |
|---|---|---|---|
| 1,622,329 | 3/1927 | MacCordy | 283/95 X |
| 1,727,912 | 9/1929 | Snyder | 283/58 X |
| 2,285,806 | 6/1942 | Close | 283/58 X |
| 3,020,171 | 2/1962 | Bakan et al. | 283/95 X |
| 3,617,334 | 11/1971 | Broc | 503/207 |
| 3,677,887 | 7/1972 | Rowsam et al. | 162/140 |
| 3,886,083 | 5/1975 | Laxer | 283/95 |
| 3,934,069 | 1/1976 | Atzrott et al. | 428/321.5 X |
| 4,136,229 | 1/1979 | Godet et al. | 162/140 X |
| 4,143,891 | 3/1979 | Neubauer | 283/95 X |
| 4,397,483 | 8/1983 | Hiraishi et al. | 428/321.5 X |
| 4,425,386 | 1/1984 | Chang | 283/95 X |
| 4,520,063 | 5/1985 | Simon et al. | 156/277 X |
| 4,596,996 | 6/1986 | Sandberg et al. | 503/215 X |
| 4,636,818 | 1/1987 | Jerabek | 503/215 X |
| 4,662,651 | 5/1987 | Mowry, Jr. | 283/95 X |

FOREIGN PATENT DOCUMENTS

| | | |
|---|---|---|
| 0041024 | 12/1981 | European Pat. Off. . |
| 2084930 | 4/1982 | United Kingdom . |

OTHER PUBLICATIONS

Gloister, G. A. *An Encyclopedia of the Book*, World Publishing Co., New York 1960, pp. 327–328.

*Primary Examiner*—Paul A. Bell

*Attorney, Agent, or Firm*—Cushman, Darby & Cushman

[57] ABSTRACT

Methods for preventing or reducing the likelihood of successful alteration of information printed on a document, wherein a detectable substance is released from ruptured microcapsules onto the document in image areas. The substance penetrates through the document to form a confirming image on the reverse surface. Another detectable substance of lesser penetrating ability simultaneously may be released onto the document in the image areas. Spreading of the first substance outside the boundaries of the image area created by the second substance may produce a halo effect around the image area. Documents as treated by the methods are disclosed, as well as articles comprising a document to be treated in contact with a sheet coated with the detectable substance. The first substance is microencapsulated, the second substance may or may not be microencapsulated.

6 Claims, 2 Drawing Sheets

10

MONEY ORDER

[5]43*21

SECURITY FOR IMAGES FORMED BY IMPACT BASED SYSTEMS

This invention pertains to methods and articles for preventing or reducing the likelihood of successful alteration of documents.

It is the unfortunate fact that many attempts are made to alter or forge documents, particularly those that have monetary value. Deeds, titles and checks are examples. Many efforts have been undertaken to prevent such practices, but considerable room for improvement remains.

GENERAL DESCRIPTION OF INVENTION

The overall object of the invention is to provide a system composed of microencapsulated agents and materials with a high degree of paper penetration characteristics to impart additional resistance to the successful alteration of information on documents. This invention overcomes past difficulties with conventional images being physically altered by removal of the image with the paper fibers containing them. In the latter case, it has been possible to repair the damage to the paper, and then forge a fake image in place of the original. The present invention provides a microencapsulated system wherein the capsules contain an agent such as a dye material dissolved in a solvent with high paper penetrating capability. When released by rupture of the capsules the agent/solvent combination rapidly will penetrate or saturate completely through the receiving sheet (document) to form a confirming image on the back or reverse side. This makes alteration by physical removal quite difficult. The invention also lends itself to the blending of the aforesaid agent/solvent combination with other imaging materials. For example, capsules containing the agent/solvent combination may be blended with a carbon/wax composition, or with other capsules containing another imaging composition. In this case, when the coated blend is imaged the agent-/solvent combination penetrates through to the back of the substrate to form a confirming "ghost image" and also outside of the boundaries of the image formed by said other material on the face. In this way what may be termed a "halo" effect is created. This further renders removal and duplication of the image more difficult, particularly if the agent/solvent combination is different in color or other appearance compared to the image formed by said other material.

Suitable materials and other details of the invention are provided below.

DISCUSSION OF PRIOR ART PATENTS

Prior U.S. patents exist that relate to substances that may be applied to papers, and use of capsules to contain them, but none use the present invention to accomplish the purposes thereof.

Rowsam et al U.S. Pat. No. 3,677,887 refers to a special paper and to penetration of ink completely through that paper. However, the disclosure is aimed directly opposite to the present invention, i.e., to avoidance of what Rowsam describes as objectionable lateral bleeding of the printed indicia when viewed from the backside of the paper. The disclosure thus points away from rather than toward the present invention.

Laxer U.S. Pat. No. 3,886,083 refers to the use of inks having dyes and fluorescent pigments, but does not refer to the penetration of a solvent-carried detectable substance to the reverse surface of a document, nor to the spreading of a substance to create any halo effect.

Atzrott et al U.S. Pat. No. 3,934,069 describes a coating on a document containing a solution or suspension of a salt of a dye base and an organic carboxylic acid in an organic water-immiscible solvent. There is no mention of penetration of substances through an underlying document. The materials described for encapsulation are not suitable for the present applicants' purposes.

Neubauer U.S. Pat. No. 4,143,891 also describes a system which relies on a coating of microcapsulated material on the surface of the document itself. The microcapsules are said to contain oleic acid or the like to wet the surface of the document. As is illustrated in FIG. 4 of the patent. The transferred image (18) does not penetrate to the reverse side of the document.

Hiraiski et al U.S. Pat. No. 4,397,483 describe recording methods obtained by combining oil-soluble dyes, microcapsules containing organic liquids and a whitening agent. However, no penetration to the reverse side of a document is mentioned nor would appear to happen using the materials suggested in the patent.

Simon U.S. Pat. No. 4,520,063 describes the use of two different quickly migrating colorants, with the result that characters in different colors are seen when viewed from opposite sides of the sheet. No halo effect is noted, nor is there reliance on capsules.

Jarabek U.S. Pat. No. 4,636,818 is directed to the use of microcapsules which contain solvent only, which therefore would not serve the purposes of the present invention, which is to get a detectable substance in a solvent to the rear surface of a document. In Jerabek it is said that the solvent-only microcapsules are to improve the intensity of the resulting image. Nothing is said about penetration of a detectable substance to the rear surface of a document.

Mowry U.S. Pat. No. 4,662,651 describes a system in which a first free chemical substance, a developer, and a second chemical substance which is a color former held in capsules are coated on a substrate. When the capsules are broken the color former unites with the developer to form an imaging material to provide a visible message. It is said that to enhance the protective powers of the system inks may be used with still another color former to provide another image of exotic or unusual hue that may appear as a halo around the primary image. However, the Mowry disclosure does not suggest the solvent-carried detectable substance of the present invention, to penetrate to the rear surface of the document, nor in so doing to create a halo effect around primary printing.

In summary, none of the above patents approach the concept of the present invention, that is, a system for promoting penetration completely through paper of a solvent carrying an agent dissolved therein with a characteristic which can be detected by readily available methods.

DESCRIPTION OF DRAWINGS

The invention will be described with the aid of illustrative embodiments. Drawings appended hereto for the purpose of the description are as follows.

DETAILED DESCRIPTION OF THE ILLUSTRATIVE EMBODIMENTS

Figure 1:
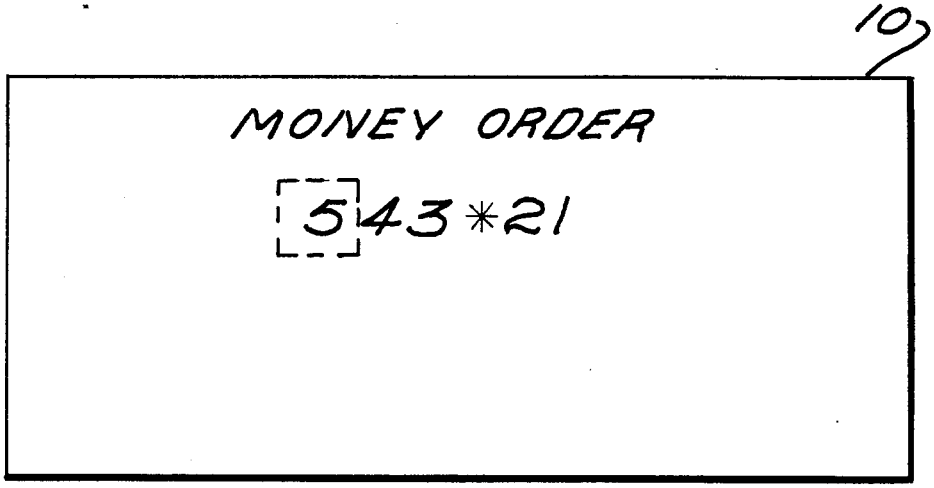
FIG. 1 shows the face of a typical money order to be protected.
Figure 2:
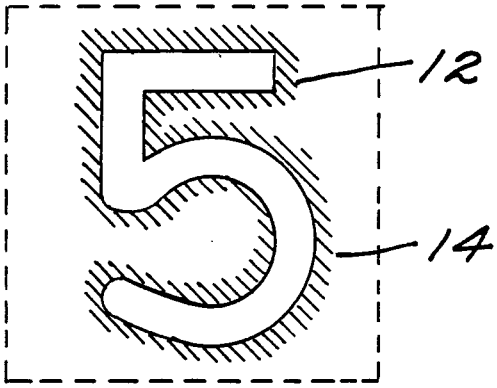
FIG. 2 shows an enlargement of an area of FIG. 1.

FIG. 1 shows the front surface of a money order or other valuable document 10 to be protected from forgery or alteration. A set of numbers 543*21 has been printed on the front surface for a clerical purpose, and the invention is illustrated in connection with these numbers. An enlargement of the image area of the number 5 is shown in FIG. 2, and a halo effect is indicated by the hatch lines 14. The creation of the image area and the halo effect area is explained below.

Figure 3:
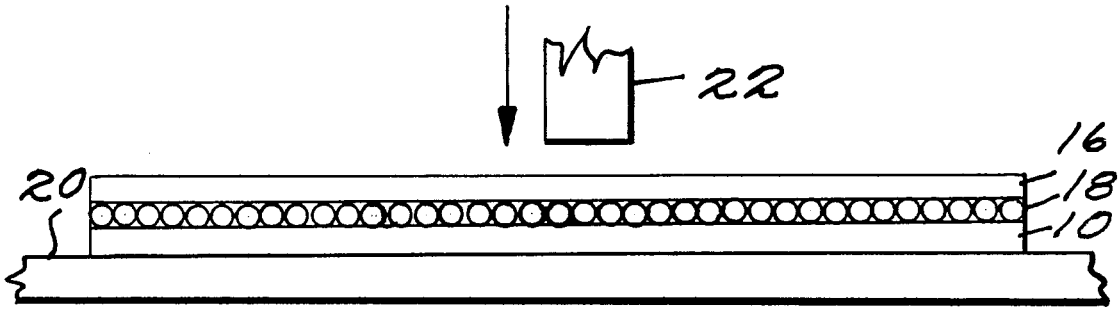
FIG. 3 shows an edge view of a document to be protected overlaid with a sheet on which a layer of capsules exists so as to place the layer between the sheet and the document.

An edge view of the document sheet 10 is shown in FIG. 3, overlaid with a sheet 16 on which a layer 18 of microcapsules has been coated. The combination of components is shown as resting on a firm base or support 20. A pressure or impact member 22 is shown above the sheet 16, to suggest how pressure may be applied (by downward movement of member 22) to rupture the capsules in an image area beneath the member 22.

Figure 4:
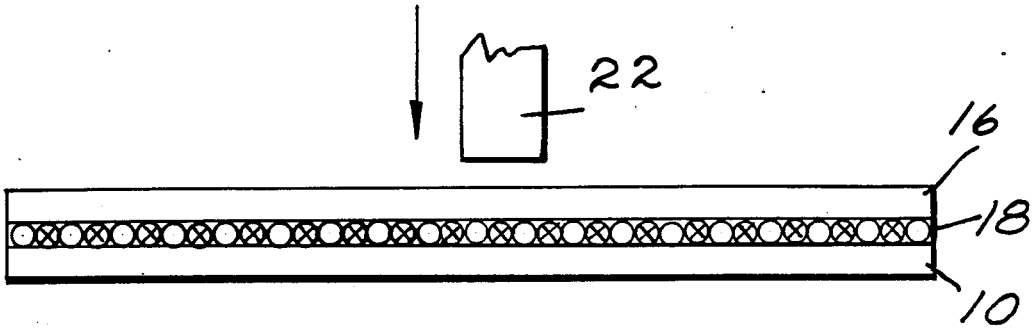
FIG. 4 shows a modification of the system of FIG. 3 with a blending of different capsules.

In FIG. 3 the capsules (exaggerated in size for purposes of illustration) are shown all of one type. FIG. 4 shows the arrangement of FIG. 3, except with alternate capsules marked with an enclosed x to suggest capsules containing a substance different from what is in the other capsules. In this way a blend of capsules may be provided.

Figure 5:
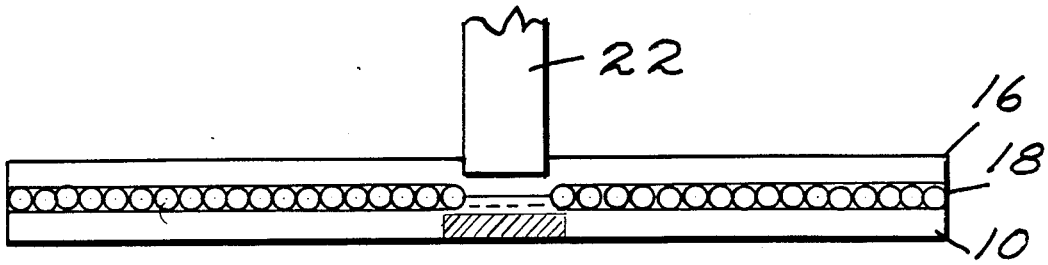
FIG. 5 shows the document as in FIG. 3 after it has been impacted.

FIG. 5 is provided to show the result in the document sheet 10 after the member 22 has impacted the sheet 16. The substance released by rupture of capsules in the image area defined by the member 22 has penetrated into the sheet 10, and spread somewhat, as denoted by the hatch lined region 24. The areas of penetration outside the physical limits of the face of member 22 create what has been referred to above as the halo effect.

Figure 6:
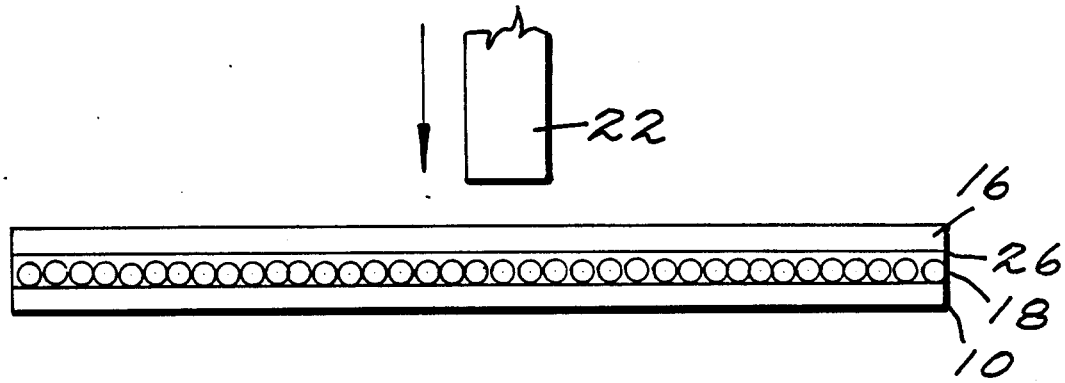
FIG. 6 shows a modification in which two different image transfer mediums are employed.

With further reference to FIG. 4, there need not be a blending of capsules. Instead, there can be other means active upon impact to create markings on the document, e.g., any of the known carbonless copying systems. For example, the capsules containing the substance could be dispersed in a carbon/wax layer. The layer 26 in FIG. 6 is to suggest the presence of another image transfer system, this one not to be susceptible to substantial spreading of the image. In this way the spreading of the encapsulated material will be noted as a halo around the image of the layer 26 material.

Turning now to the composition of the involved substances, what is contained in the microcapsules is a solvent with a high degree of paper penetrating capability, carrying an agent dissolved therein with a characteristic which may easily be detected by readily available methods. The substance will rapidly saturate or penetrate completely through the receiving paper substrate (the document 10) to form a confirming image on the back. Furthermore, when used as an addition to other more typical imaging systems, this combination can show a strong tendency to carry its agents slightly outside the boundaries of the conventional image to form an easily recognizable halo effect. These effects of complete penetration to the back and the formation of a halo tend to make both the removal and alteration/replacement of information more difficult, and act as a deterrent.

Agents for use in this invention with easily detected characteristics are those with solubility in the solvents of preference, compatibility with microencapsulation techniques and a physical or chemical property or properties which can easily be detected by methods readily available in everyday situations. Examples of such properties are those which can be detected by he human senses such as sight, touch or smell; agents which react to heat, moisture or pressure; agents which exhibit reaction, absorbance or fluorescent to specific wavelengths of light such as UV; agents which show chemical reactivity to bleach, developing chemicals and the like. Solubility in the solvents of preference is important since penetration through the paper is best accomplished via a solution rather than a suspension or dispersion. Compatibility with microencapsulation techniques implies that the agent will retain its recognizable properties through the encapsulation phase and into the imaging step.

Many techniques for microencapsulation are well known. The type of microencapsulation system used is of relatively low importance as long as the agent/solvent combination is held and maintained in a state suited for its end purpose and the microcapsule can be introduced into an imaging system such as a coating on paper, an ink on film or ribbon, etc. Types of microencapsulation systems successfully examined to date include interfacial polycondensation using for instance, a polyamide as the wall material, simple conservation using gelatin-gum arabic and complex coascervation using urea-formaldehyde.

Solvents which are suitable for use in the invention are those possessing strong paper penetrating capability, which can dissolve the reactive agents in question and can be encapsulated by one or more of the techniques given above. These would include aromatic and aliphatic hydrocarbons which are liquid and have low to medium volatility at room temperature. Particularly preferred are the lower molecular weight aliphatic hydrocarbons such as deodorized kerosene blends, n-paraffinic oils and blends, isoparaffinic oils and blends. Also, naphthenic oils and blends could be used.

In all cases images formed from the examples which displayed good penetration through the sheet to the back and a halo effect were judged to be more difficult to remove and/or alter/replace.

Two samples resulting from practice of this invention are filed with this application (mounted on a sheet following the claims). These samples have been labeled "A" and "B" in the upper left corners. These samples were imprinted by a blend of 70% by weight of an oil soluble red dye in a paraffin oil solvent in encapsulated form and 30% by weight of a carbon black pigment in encapsulated form coated on a 9.7 pound tissue substrate. The result is a dark red indicia in which the red dye has formed a confirming image on the back side and has migrated outside the boundaries of the carbon black image to give a "halo" effect on the front. Sample B was produced in the same way as Sample A, but the right hand side has been washed with solvent in an attempt to remove the imprinted indicia such as might be attempted for a fraudulent change. It will be noted that the back image and red halo has been washed out, however, the black carbon pigment has not. A faint blue chord line may be seen running from the top to the bottom of the paper approximately two (2) inches from the right edge. This is the wash solvent boundary mark and is not related to the imaging system. It should be noticed that anyone attempting to remove the printed indicia and substitute false information will have to remove the carbon black pigment and replace the red halo and the confirming back image in the same appearance as the original.

Typically, any soluble dye may be used in the practice of this invention. Preferred, however, are dyes with strong color absorbance, good solubility in the solvents of preference, good stability to ambient heat, light and moisture conditions and compatibility with typical microencapsulation systems. A preferred example would be an alkyl derivative of an azobenezene - azo napthol sold by Dupont under the trade name "Oil Red." Solvents typically should be low surface tension liquids possessing good paper penetrating capability, compatibility with typical microencapsulation systems and a low order of toxicity. A preferred example would be a paraffin oil of high purity manufactured by Exxon and sold under the trade name Norpar or Isopar.

It will be noted in the following examples that a 9.7 pound tissue has been used for application of the transfer coating. (9.7 pound means that a stack of 500 sheets of tissue, each 20 inches by 30 inches, will weigh 9.7 pounds.) That is because a tissue will typically be used as an interleave in a bank card, credit slip or postal money order form set construction. Other transfer paper weights may successfully be used. However, in order to keep form sets within an acceptable caliper of thickness and maintain suitable imaging capability, tissue is typically used. Other than this limitation, there is no criticallity on the thickness of the transfer sheet depending on the applications.

Organic dyestuffs which may be used are those with strong color absorbance, good solubility in the solvents of preference, good stability to ambient light, heat, moisture conditions and which are compatible with the microencapsulation system. Particularly preferred is an alkyl derivative of azobenzene-azo-napthol sold by Dupont under the trade name "Oil Red."

EXAMPLES

1. Dupont Oil Red B liquid was microencapsulated in Exxon Norpar 15 (normal paraffin oil) at a 10% concentration by weight using interfacial polycondensation and a polyamide as the capsule wall component. Lab drawdowns were made on 9.7 pound tissue at a deposit weight of approximately 5–6 grams per square meter (gsm) dry. When placed coated side down in a form set configuration consisting of

| | |
|---|---|
| _____ | 12 pound bond |
| _____ | Coating of Oil Red B capsules on the tissue |
| _____ | Receiving Bond Sheet |

and imprinted using a 0.0039 inch (0.0039") gapped credit card imprinter, a bright red image formed on the face of the receiving bond sheet penetrated completely through to the back of the receiving bond sheet in a time period ranging from several seconds to several hours. This occurred for various receiving sheets ranging in basis weight from 9 to 100 pounds 17×22×500 (meaning that a stack of 500 sheets each 17 inches by 22 inches would weigh from 9 pounds to 100 pounds, depending on the paper selected), 2. Cartax DPXT, a compound available from Sandoz Chemical Company with bright yellow fluorescence under UV light exposure was microencapsulated in dibutylphthalate at 1% concentration by weight using interfacial polycondensation and a polyamide as the capsule wall component. Lab drawdowns were made on 9.7 pound tissue at a deposit weight of approximately 6 gsm dry. When placed coated side facing up in a form set configuration consisting of

| | |
|---|---|
| _____ | Bond Receiver Sheet |
| _____ | Cartax DPXT Coating/Tissue |
| _____ | 20 pound Bond Sheet |

and imprinted using a 0.0039" grapped credit card imprinter, an invisible image which appeared light yellow under UV light exposure was formed on the back of the receiving bond sheet which penetrated completely through to the face of the receiving bond sheet in a time period of several hours to several days. This occurred for receiving sheets ranging from 9 to 33 pounds 17×22×500 basis weight.

3. Copikem X, a carbonless dye precursor available from Hilton-Davis Chemical Company with a high degree of solubility, was microencapsulated in Exxon Norpar 15 at 7% concentration by weight using interfacial polycondensation and a polyamide as the capsule wall component. Lab drawdowns were made on 9.7 pound tissue at a deposit weight of approximately 5 gsm dry. When placed coated side facing up in a form set configuration similar to that used for example 2 and imprinted using a 0.0039" gapped credit card imprinter an invisible image which could be developed by wiping with a cloth containing a small amount of phenolic resin dissolved in toluene was formed on the back of the receiving bond sheet which penetrated completely through to the face of the receiving bond sheet in a time period of several seconds to several hours. This occurred for various receiving sheets ranging in basis weight from 9 to 50 pounds 17×22×500.

4. Cyasorb UV 5411, a compound available from American Cyanamid Company with strong UV absorbance was microencapsulated in Exxon Norpar 15 at 10% concentration by weight using interfacial polycondensation and a polyamide as the capsule wall component. Lab drawdowns were made on 9.7 pound tissue at a deposit weight of approximately 5 gsm dry. When placed coated side facing up in a form set configuration similar to that used for example 2 and imprinted using a 0.0039" gaped credit card imprinter an invisible image which appeared black under UV light exposure in contrast to the fluorescence of the paper was formed on the back of the receiving bond sheet which penetrated completely through to the face of the bond receiver sheet in a time period ranging from several seconds to several hours. Detection of the latent image area could be made easier by drawing a felt-tip pen containing a UV fluorescent dye over the latent image. This occurred for various receiving sheets ranging in basis weight from 9 to 50 pounds 17×22×500.

5. Copikem X microcapsules prepared and coated as in example 3 were imaged by imprinting in a similar manner on a receiver sheet which had been coated on the face side with a thin layer of bis-phenol A particles.

After penetration the latent image could be developed on the face of the receiver sheet by the application of heat.

6. Dupont Oil Red B liquid was microencapsulated at 10% concentration in Exxon Isopar M using a dual-wall encapsulation technique according to the teachings of Canadian patent No. 854,142 to Baxter and using a combination of a polyamide and gelatin-gum arabic as the capsule wall components. When coated and treated in a similar manner to that used in example 1, similar results regarding imaging and penetration were achieved.

7. Capsules from example 1 were blended with Permascan capsules at rates of 20, 30, 40, and 70% (dry on dry) and coated on 9.7 pound tissue at deposit weights ranging from 5.5 to 6.5 gsm dry. When placed coated side facing down in a form set configuration consisting of

| | |
|---|---|
| _____ | 12 pound Bond |
| _____ | Oil Red B Coating/Tissue |
| _____ | 24 pound OCR Bond Sheet |
| _____ | 20 pound Bond |

and imprinted on a 0.0039" gapped credit card imprinter a black or blackish-red image was formed on the face of the receiving sheet which developed a reddish halo and a bright red back image over a time period ranging from several seconds to several hours. Permascan is the trade name for a product of Moore Business Forms, which comprises an imaging system in which encapsulated carbon black is used. When using the Permascan system the microencapsulated dye/solvent may be incorporated into the Permascan prior to coating. In this manner, when the coated blend is imaged the dye/-solvent combination penetrates the substrate to form a confirming image on the back and spreads slightly outside of the boundaries of the Permascan image to form the halo effect. Attempts to remove the image by abrasion were unsuccessful inasmuch as the paper substrate was completely destroyed, leaving a hole in the paper.

8. The capsules from example 3 were coated over the top of a conventional carbon/wax coating on tissue paper at a dry weight of approximately 4 gsm. When placed in a configuration similar to that used in example 6 and imprinted in a similar manner, a black image was formed on the face of the receiver sheet. After allowing several minutes to several hours for penetration depending on the basis weight of the receiver sheet, a blue halo and a blue confirming image on the back could be developed on the receiver sheet by wiping the appropriate side with a cloth containing phenolic resin dissolved in toluene. This occurred for receiver sheets ranging in basis weight from 9 to 24 pounds 17×22×500.

9. Capsules from example 6 were coated over a conventional inked typewriter ribbon at a weight estimated to be 1–3 gsm dry. When the ribbon was placed in its customary position in a typewriter, and bond sheets imaged by typing the letters "C", "R", and "T" consecutively across the page, images were formed which quickly developed a reddish halo and a bright red confirming image on the back over a time period of several seconds to several hours. This occurred for various receiving sheets ranging in basis weight from 9 to 100 pounds 17×22×500.

Upon reading the foregoing descriptions of illustrative embodiments additional embodiments of the invention will occur to others. Therefore, the scope of the invention is to be determined by the following claims.

What is claimed is:

1. A method for preventing or reducing the likelihood of successfully altering information printed on a document, comprising:

(a) providing a document having an image area thereon, which area possesses the property of permitting penetration of fluids therethrough;

(b) encapsulating a detectable agent and a liquid hydrocarbon having low to medium volatility at room temperature and a high degree of paper penetrating capability so that it will penetrate through the document;

(c) coating said encapsulated hydrocarbon and said agent onto a sheet of paper;

(d) overlaying said coated sheet onto said document; and, (e) releasing said encapsulated hydrocarbon and agent onto said document whereby said hydrocarbon and agent penetrates and spreads through said document to produce a halo effect and to become detectable on the opposite side thereof.

2. A method as in claim 1 and including the further step of blending said encapsulated hydrocarbon and agent with a pigment to provide the blend on said sheet of paper, whereby upon the release of the blend with said pigment therein there will be produced a permanent image on said document with the hydrocarbon and agent penetrating through said document to form a confirming image on the reverse side of said document.

3. A method as in claim 1 or 2 in which the agent is an organic dyestuff which is soluble in the hydrocarbon.

4. A method as in claim 1 or 2 in which the hydrocarbon is an aliphatic hydrocarbon which is liquid and volatile at room temperature.

5. A method as in claim 1 or 2 in which the hydrocarbon is an aromatic hydrocarbon which is liquid and volatile at room temperature.

6. A method as in claim 1 or 2 in which the hydrocarbon is selected from one or more members of a group consisting of deodorized kerosene blends n-paraffinic oils and blends, isoparaffinic oils and blends and naphthenic oils and blends.

* * * * *